US011198207B2

(12) United States Patent
Choi

(10) Patent No.: US 11,198,207 B2
(45) Date of Patent: Dec. 14, 2021

(54) WAFER POLISHING APPARATUS

(71) Applicant: SK SILTRON CO., LTD., Gumi-si (KR)

(72) Inventor: Yong Choi, Seoul (KR)

(73) Assignee: SK Siltron Co., Ltd., Gumi-Si (KR)

( * ) Notice: Subject to any disclaimer, the term of this patent is extended or adjusted under 35 U.S.C. 154(b) by 321 days.

(21) Appl. No.: 16/004,722

(22) Filed: Jun. 11, 2018

(65) Prior Publication Data

US 2019/0210182 A1 Jul. 11, 2019

(30) Foreign Application Priority Data

Jan. 8, 2018 (KR) ..... 10-2018-0002075

(51) Int. Cl.

| | |
|---|---|
| ***B24B 37/34*** | (2012.01) |
| ***B24B 37/10*** | (2012.01) |
| ***B24B 55/03*** | (2006.01) |
| *B24B 55/04* | (2006.01) |

(52) U.S. Cl.

CPC ..... *B24B 37/34* (2013.01); *B24B 37/105* (2013.01); *B24B 55/03* (2013.01); *B24B 55/045* (2013.01)

(58) Field of Classification Search

CPC ..... B24B 55/03; B24B 55/045; B24B 37/34; B24B 37/105

USPC ..... 451/259, 456, 158, 159, 160, 161

See application file for complete search history.

(56) References Cited

U.S. PATENT DOCUMENTS 6,419,567 B1 * 7/2002 Glashauser ..... B24B 37/32 451/259
6,488,573 B1 * 12/2002 Kobayashi ..... B24B 53/017 451/285
7,575,503 B2 * 8/2009 Benner ..... B24B 53/00 451/21
7,883,394 B2 * 2/2011 Togawa ..... B24B 37/015 451/7
10,279,452 B2 * 5/2019 Yamanaka ..... B24B 7/22
2009/0264049 A1 * 10/2009 Chen ..... B08B 15/04 451/28
2013/0240000 A1 * 9/2013 Aizawa ..... B01D 19/0057 134/104.4

(Continued)

FOREIGN PATENT DOCUMENTS

| | | | |
|---|---|---|---|
| CN | 1672876 | 9/2005 | |
| GB | 848841 | 9/1960 | |
| GB | 848841 A * | 9/1960 | ..... B24B 55/102 |

(Continued)

OTHER PUBLICATIONS

Chinese Office Action dated Jun. 22, 2020 issued in Application No. 201810796570.4 (English translation attached).

*Primary Examiner* — Joseph J Hail
*Assistant Examiner* — J Stephen Taylor
(74) *Attorney, Agent, or Firm* — KED & Associates LLP

(57) ABSTRACT

The present invention provides a wafer polishing apparatus, including: a surface plate having a polishing pad attached on an upper surface thereof; a slurry injection nozzle configured to inject slurry toward the polishing pad; at least one polishing head configured to accommodate a wafer and rotate at an upper portion of the surface plate; an index configured to support so as to connect the at least one polishing head at an upper portion thereof; and a particle suction part coupled to the index and configured to suck particles generated during polishing of the wafer.

7 Claims, 3 Drawing Sheets

(56) References Cited

U.S. PATENT DOCUMENTS

| | | | | |
|---|---|---|---|---|
| 2015/0099426 | A1* | 4/2015 | Ronshaugen | B24B 37/345 451/9 |
| 2015/0314418 | A1* | 11/2015 | Shinozaki | B24B 55/12 156/345.12 |

FOREIGN PATENT DOCUMENTS

| | | | |
|---|---|---|---|
| JP | 2001-129760 | | 5/2001 |
| JP | 2002-144227 | | 5/2002 |
| JP | 2003-340718 | | 12/2003 |
| JP | 2003340718 | A * | 12/2003 |
| JP | 2006-088292 | | 4/2006 |
| JP | 4455833 | | 4/2010 |
| JP | 2015-196206 | | 11/2015 |
| JP | 2015-208844 | | 11/2015 |
| JP | 2017-140663 | | 8/2017 |
| JP | 6357861 | B2 * | 7/2018 |
| KR | 10-1999-0077610 | | 10/1999 |
| KR | 10-0687115 | | 2/2007 |
| WO | WO 2017/073845 | | 5/2017 |

* cited by examiner

WAFER POLISHING APPARATUS

CROSS-REFERENCE TO RELATED APPLICATION(S)

This application claims priority under 35 U.S.C. § 119 to Korean Patent Application No. 10-2018-0002075 filed in Korea on 8 Jan. 2018 which is hereby incorporated in its entirety by reference as if fully set forth herein.

TECHNICAL FIELD

The present invention relates to a wafer polishing apparatus, and more particularly, to an apparatus for processing particles, which are generated during polishing of a wafer.

BACKGROUND

A fabricating process of a silicon wafer includes a single crystal growth process for fabricating a single crystal ingot, a slicing process for obtaining a thin disk-shaped wafer by slicing a single crystal ingot, an edge grinding process for machining an outer circumferential portion of a wafer to prevent cracking and distortion of the wafer obtained by the slicing process, a lapping process for removing damages due to mechanical processing remaining on a wafer, a polishing process for mirror-polishing a wafer, and a cleaning process for removing abrasive or foreign substances adhering to a wafer.

Among the processes, the wafer polishing process may be performed through various steps and may be performed via a wafer polishing apparatus.

FIG. 1 is a perspective view of a general wafer polishing apparatus, and FIG. 2 illustrates a process of processing particles generated during polishing of a wafer as a cross-sectional view of FIG. 1.

As shown in FIG. 1, a general wafer polishing apparatus may include a surface plate 11 on which a polishing pad 13 is attached, a polishing head 21 configured to surround a wafer W and rotate on the surface plate 11, and a slurry injection nozzle 30 configured to supply slurry S to the polishing pad 13.

The surface plate 11 may be rotated by a surface plate rotation shaft 12 during a polishing process, and the polishing head 21 may be rotated by a head rotation shaft 22 in a state of being in close contact with the polishing pad 13. At this point, the slurry S supplied by the slurry injection nozzle 30 may polish the wafer W to a mirror-finished surface while being infiltrated toward the wafer W located on the polishing head 21.

As shown in FIG. 2, during polishing of the wafer W via the wafer polishing apparatus, particles P may be generated and scattered into air. In particular, in the case of a final polishing (FP) process for finely polishing the wafer W, more fine particles P may be generated.

As described above, since the particles P generated during the wafer polishing process are adsorbed onto the wafer W and cause a fine step difference on the wafer W during polishing of a wafer, and deterioration in polishing quality, that is, a polishing induced defect (PID) occurs, it is necessary to remove the particles P during or after the wafer polishing process.

SUMMARY

The present invention is directed to providing a wafer polishing apparatus capable of efficiently removing particles generated in a wafer polishing process during or after the polishing process to improve wafer polishing quality.

The present invention provides a wafer polishing apparatus, including: a surface plate having a polishing pad attached on an upper surface thereof; a slurry injection nozzle configured to inject slurry toward the polishing pad; at least one polishing head configured to accommodate a wafer and rotate at an upper portion of the surface plate; an index configured to support so as to connect the at least one polishing head at an upper portion thereof; and a particle suction part coupled to the index and configured to suck particles generated during polishing of the wafer.

The particle suction part may be disposed to surround an outer circumferential surface of the at least one polishing head.

Both end portions of the particle suction part may be disposed spaced apart from each other so that the slurry injection nozzle is interposed therebetween.

The particle suction part may include a main body coupled to the index to surround the outer circumferential surface of the polishing head; a guide having a suction hole and disposed at a lower portion of the main body; and an air pump installed at the index and configured to suck particles through the guide.

A flow path which communicates with the suction hole and through which the sucked particles move may be formed at an inner side the main body and the guide.

The guide may have a pointed shape as it goes downward.

The suction hole may have a slot shape disposed long along an inner circumferential surface of the guide so as to be adjacent to the polishing head.

The suction hole may be disposed in plural spaced apart from the guide.

The main body and the guide may be formed in plural, and may be disposed to surround the outer circumferential surface of the polishing head while being spaced apart from each other at a predetermined interval.

The wafer polishing apparatus may further include an exhaust part disposed at a lower portion of the surface plate to suck and discharge the particles.

DETAILED DESCRIPTION OF THE EMBODIMENTS

Figure 1:
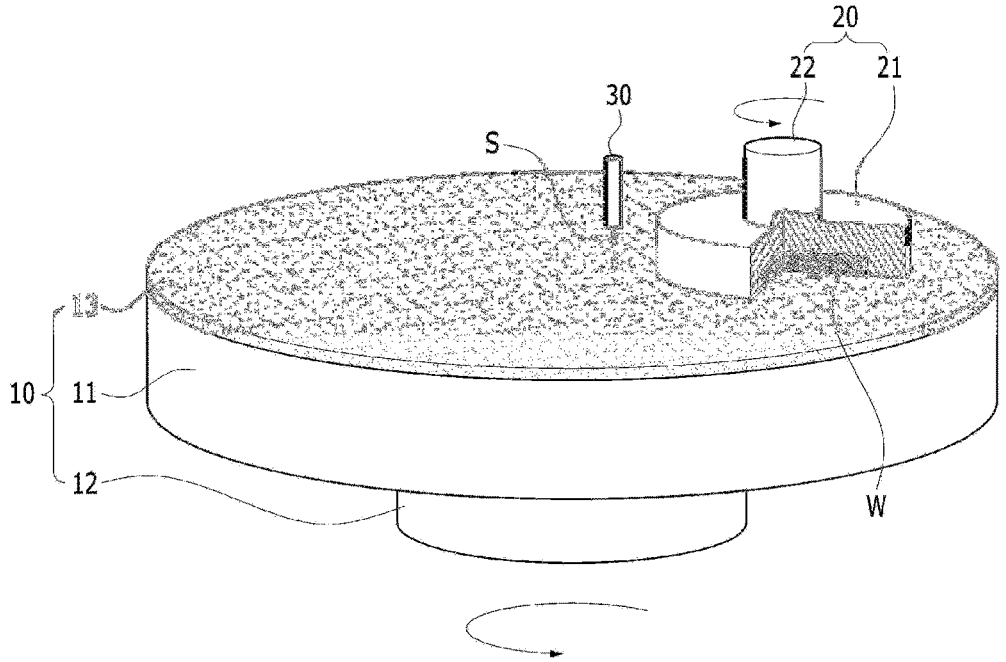
FIG. 1 PRIOR ART
FIG. 1 is a perspective view of a general wafer polishing apparatus.
Figure 2:
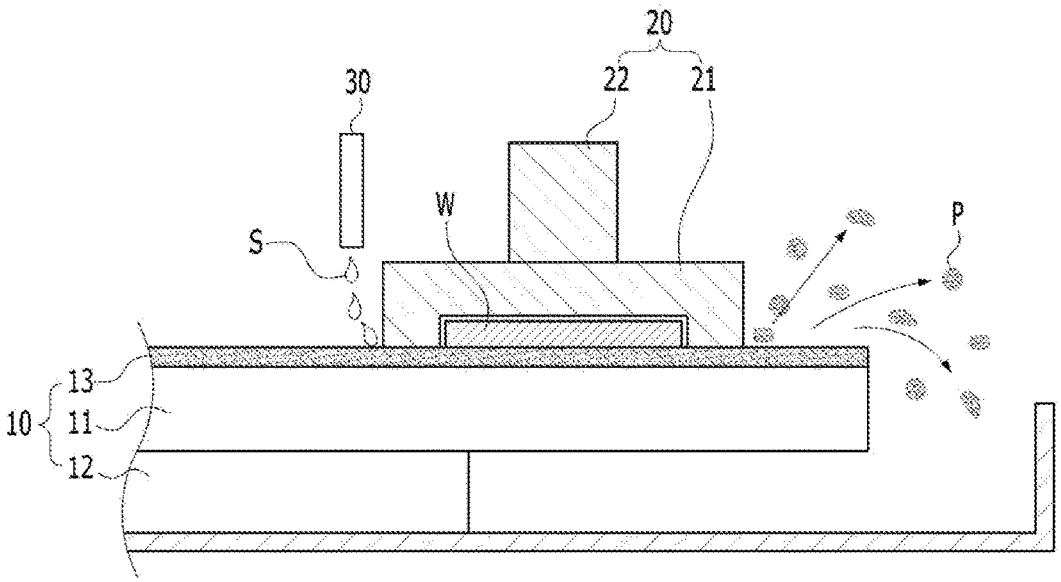
FIG. 2 PRIOR ART
FIG. 2 illustrates a process of processing particles generated during polishing of a wafer as a cross-sectional view of FIG. 1.

Hereinafter, embodiments will be shown more apparent through the description of the appended drawings and embodiments. In the description of the embodiment, when it is described that each layer (film), region, pattern, or structure is formed "above/on" or "below/under" a substrate, each layer (film), region, pad or pattern, the description includes being formed both "directly" or "indirectly (by interposing another layer)" "above/on" and "below/under". Also, a standard of above/on or below/under of each layer will be described with respect to the drawings.

Areas in the drawings may be exaggerated, omitted, or schematically described for a convenient and precise description. In addition, the size of each component does not fully match the actual size thereof. Further, like reference numbers represent like elements through description of the drawings. Hereinafter, an embodiment will be described with reference to the accompanying drawings.

A wafer polishing apparatus may perform several steps of polishing processes such as primary, secondary, tertiary, etc. while a wafer is loaded and unloaded, and the present embodiment may be applied during all the wafer polishing processes.

Figure 3:
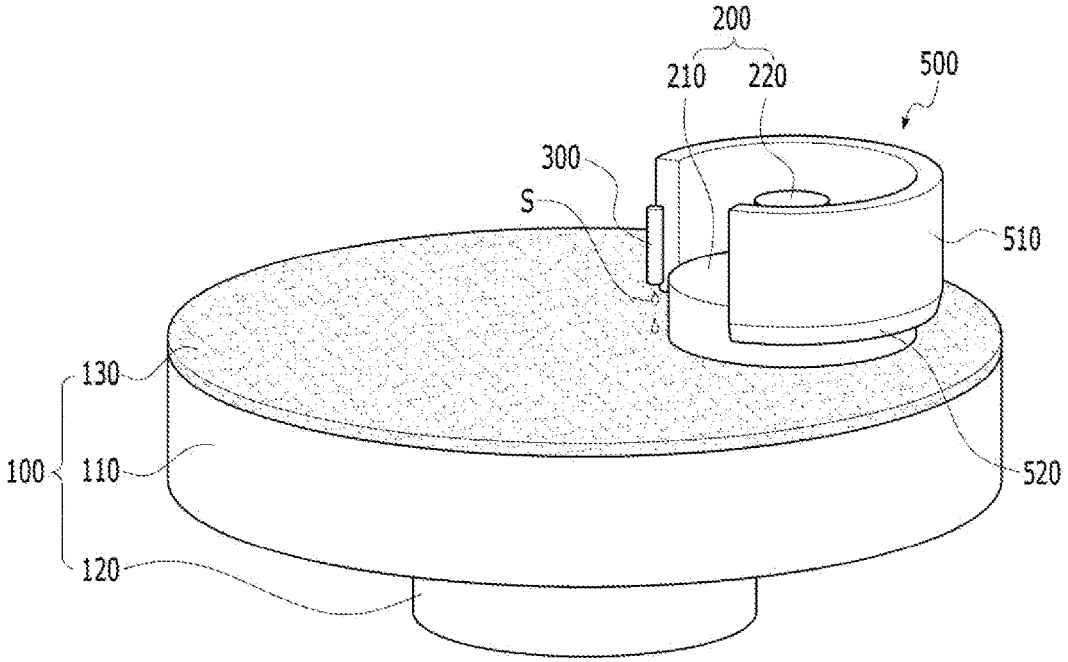
FIG. 3 is a perspective view of a wafer polishing apparatus according to one embodiment of the present invention.
Figure 4:
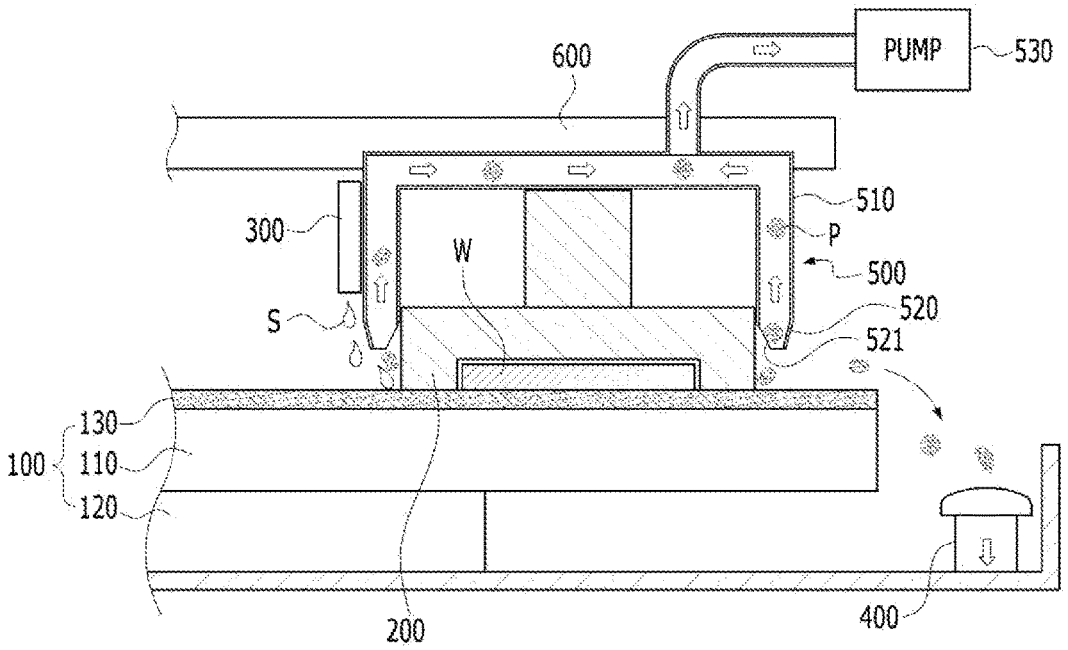
FIG. 4 illustrates a process of processing particles generated during polishing of a wafer as a cross-sectional view of FIG. 3.
Figure 5:
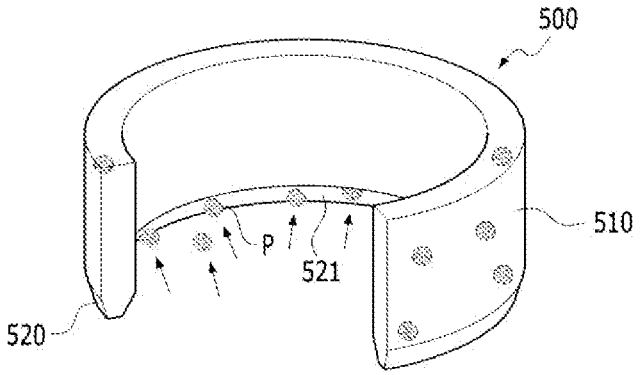
FIG. 5 is a perspective view of a main part of a particle suction part of FIG. 3.
Figure 6:
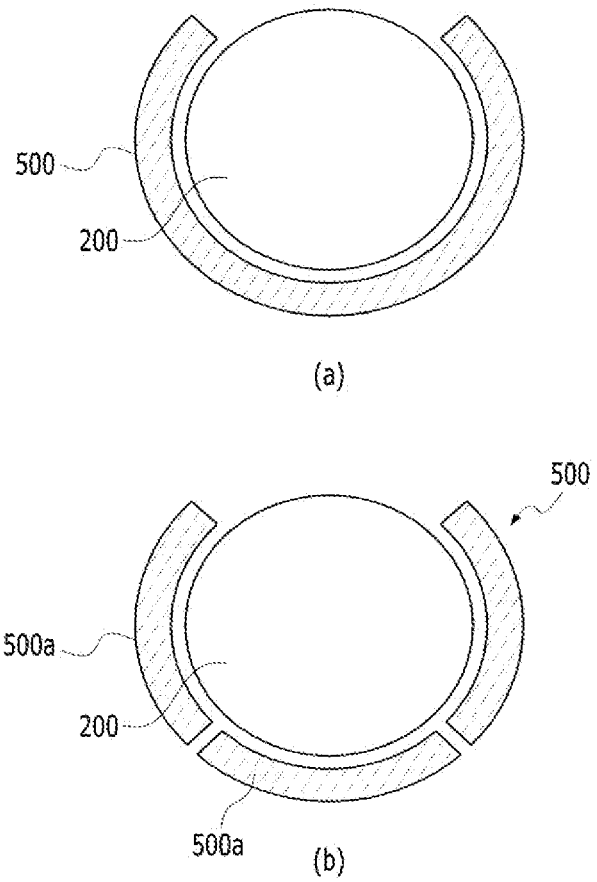
FIG. 6 is embodiments illustrating a disposition structure of a particle suction part.

FIG. 3 is a perspective view of a wafer polishing apparatus according to one embodiment of the present invention, FIG. 4 illustrates a process of processing particles generated during polishing of a wafer as a cross-sectional view of FIG. 3, FIG. 5 is a perspective view of a main part of a particle suction part of FIG. 3, and FIG. 6 is embodiments illustrating a disposition structure of a particle suction part.

As shown in FIGS. 3 to 6, the wafer polishing apparatus according to one embodiment of the present invention may include a surface plate unit 100, a polishing head unit 200, a slurry injection nozzle 300, and a particle suction part 500.

The surface plate unit 100 may configure a stage in which a polishing process is performed while a wafer W to be polished is placed. The surface plate unit 100 may include a surface plate 110, a polishing pad 130, and a surface plate rotation shaft 120, and may be referred to as a surface plate assembly.

The surface plate 110 may be formed in a cylindrical or disc-like shape and may have a larger diameter size than that of the polishing head unit 200. For example, a plurality of polishing head units 200 may be placed on the surface plate 110 so that the polishing of a plurality of wafers W may be performed at the same time.

The polishing pad 130 may be attached to an upper portion of the surface plate 110 and may have a size corresponding to a diameter of the surface plate 110. The polishing may be performed while the polishing pad 130 is in contact with a bottom surface of the wafer W mounted on the polishing head unit 200.

The surface plate rotation shaft 120 may be coupled to the surface plate 110 to rotate the surface plate 110 during the polishing process. For example, the surface plate rotation shaft 120 may rotate the surface plate 110 in a clockwise or counterclockwise direction during the polishing process, and may fix the surface plate 110 to a fixed position without rotating the surface plate 110 as necessary.

The polishing head unit 200 may be moving upward or downward while being disposed on an upper portion of the surface plate unit 100. At least one polishing head unit 200 may be disposed on the upper portion of the surface plate 110. A drawing shows that the polishing head unit 200 is disposed in one on the upper portion of the surface plate 110, but may be disposed in plural such as two and three.

The polishing head unit 200 may include a polishing head 210 configured to accommodate the wafer W and a head rotation shaft 220 configured to rotate the polishing head 210.

The polishing head 210 may accommodate the wafer W to an inner side thereof in a form of surrounding an upper portion surface and a side surface of the wafer W to be polished. Therefore, the wafer W may be in contact with the upper portion of the surface plate 110, that is, an upper surface of the polishing pad 130 in a state of being fixed to the polishing head 210.

The head rotation shaft 220 may be coupled to an upper portion of the polishing head 210 to rotate the polishing head 210 in a clockwise or counterclockwise direction, and may fix the polishing head 210 to a fixed position without rotating the polishing head 210 as necessary. The head rotation shaft 220 may be fixed to an index 600 located at an upper portion thereof as shown in FIG. 4.

The index 600 may fix the polishing head 210 by a large cylindrical shaft located at a center of the wafer polishing apparatus and may move the wafer W accommodated in the polishing head 210 to a next step of the polishing process such as primary, secondary, tertiary, etc.

The slurry injection nozzle 300 may inject slurry S toward the polishing pad 130 to polish the wafer W in the polishing process. The slurry S is a fluid in a state in which solid particles such as powder are suspended, and may polish a surface of the wafer W while being in contact with the wafer W.

The slurry injection nozzle 300 may be installed adjacent to the polishing head 210, while being coupled to the index 600 or having a separate line from outside. The slurry injection nozzle 300 may inject the slurry S toward the polishing pad 130 during the polishing process to infiltrate the slurry S to a lower surface of the wafer W located below the polishing head 210.

The particle suction part 500 may suck particles P generated during polishing of the wafer W and may remove the particles P generated in the polishing process during or after the polishing process. In particular, the particle suction part 500 immediately removes fine particles P generated in a final polishing (FP) process at a position adjacent to the polishing head 210, thereby improving internal environment cleanliness of the polishing apparatus.

The particle suction part 500 may be disposed to surround an outer circumferential surface of the above-described polishing head 210. For example, when the polishing head 210 is formed in one, the particle suction part 500 may be disposed to surround an outer circumferential surface of the one polishing head 210, and when the polishing head 210 is formed in plural, the particle suction part 500 may be disposed in plural to surround outer circumferential surfaces of the plurality of polishing heads 210.

The particle suction part 500 may be coupled to the index 600, which supports so as to connect at least one polishing head 210 at an upper portion thereof as shown in FIG. 4. Therefore, the particle suction part 500 may immediately suck and remove the particles P scattering at a position adjacent to the polishing head 210 during the polishing process. The particle suction part 500 may be made of a material such as metal, which does not cause contamination.

More specifically, the particle suction part 500 may include a main body 510, a guide 520, and an air pump 530.

The main body 510 may be coupled to the index 600 to surround the outer circumferential surface of the polishing head 210. For example, the main body 510 may have a larger form than a diameter of the polishing head 210 and may be disposed to surround the polishing head 210 from the outside.

Both end portions of the main body 510 may be disposed spaced apart from each other so that the slurry injection nozzle 300 is interposed therebetween. For example, the main body 510 may have a shape of a horse's hoof as shown in FIGS. 5 and 6. Of course, in the embodiment, which is not interfered with a position of the slurry injection nozzle 300, the main body 510 may have a closed loop shape forming a concentric circle while surrounding the outer circumferential surface of the polishing head 210.

The guide 520 is disposed at a lower portion of the main body 510 and may guide a suction direction so as to efficiently perform suction of the particles P. The guide 520 may have a pointed shape as it goes downward. For example, the guide 520 may have a pointed shape and may have a suction hole 521 at one side thereof, and may be formed to extend integrally with the main body 510 at the lower portion of the main body 510.

The suction hole 521 may be a suction port for sucking the particles P, and may have various shapes and numbers. For example, the suction hole 521 may be disposed along an inner circumferential surface of the guide 520 so as to be adjacent to the polishing head 210. The disposition structure of such a suction hole 521 allows the particles P generated from the wafer W to be quickly sucked in at a nearest distance. Therefore, it is possible to increase an amount of particles P sucked while reducing a scattering rate of the particles P generated during polishing.

The suction hole 521 may form a slot along the inner circumferential surface of the guide 520 and may be modified to a plurality of holes spaced apart from the guide 520 at a predetermined interval.

As shown in FIG. 4, a flow path which communicates with the suction hole 521 and through which the sucked particles P move may be formed at an inner side of the above-described main body 510 and the guide 520. The flow path may be connected to the air pump 530 and may further install a separate exhaust line capable of discharging the particles P moving along the flow path to the outside of the wafer polishing apparatus.

The air pump 530 may operate to forcedly suck the particles P through the suction hole 521 of the guide 520. For example, the air pump 530 may be installed at the index 600, and may be installed outside the index 600 as necessary.

The particle suction part 500 may not be limited to the above-described form, and may be formed in plural like a particle suction part 500*a* as shown in FIG. 6 (*b*). That is, the main body 510 and the guide 520 may be formed in plural and may be disposed to surround an outer circumferential surface of the polishing head unit 200, that is, the polishing head 210 while being spaced apart from each other at a predetermined interval.

The particle suction part 500 including the above-described structure may immediately suck and remove the particles P scattering at a position adjacent to the polishing head 210 during or after the polishing process as shown in FIG. 4.

Meanwhile, an exhaust part 400 may be installed at a lower edge of the surface plate 110 to suck and discharge the particles P scattering and falling down while not being removed by the above-described particle suction part 500. That is, when the scattered particles P fall below the surface plate 110, the exhaust part 400 may suck and remove the particles P.

As described above, according to the wafer polishing apparatus of the present invention, the particles P generated in the wafer polishing process are efficiently removed by the particle suction part and the exhaust part during or after the polishing process to improve a PID, and thus wafer polishing quality can be improved.

According to a wafer polishing apparatus of the present invention, particles generated in a wafer polishing process are efficiently removed by a particle suction part during or after the polishing process to improve a PID, and thus wafer polishing quality can be improved.

The features, structures, effects and the like described in the embodiments are included in at least one embodiment of the present invention and are not necessarily limited to only one embodiment. Furthermore, the features, structures, effects and the like illustrated in the embodiments may be combined or modified with other embodiments by those skilled in the art to which the embodiments belong. Accordingly, it is to be understood that such combination and modification are included in the scope of the present invention.

DESCRIPTION OF REFERENCE NUMERALS

| | |
|---|---|
| 100: surface plate unit | 110: surface plate |
| 120: surface plate rotation shaft | 130: polishing pad |
| 200: polishing head unit | 210: polishing head |
| 220: head rotation shaft | 300: slurry injection nozzle |
| 400: exhaust part | 500, 500a: particle suction part |
| 510: main body | 520: guide |
| 521: suction hole | 530: air pump |
| 600: index | P: particle |
| W: wafer | S: slurry |

What is claimed is:

1. A wafer polishing apparatus comprising:

a surface plate having a polishing pad attached on an upper surface thereof;

a slurry injection nozzle configured to inject slurry toward the polishing pad;

at least one polishing head configured to accommodate a wafer and rotate at an upper portion of the surface plate;

an index configured to support the at least one polishing head at an upper portion of the polishing head; and a particle suction part coupled to the index and configured to suck particles generated during polishing of the wafer, wherein the particle suction part comprises:

a main body coupled to the index to surround a portion of an outer circumferential surface of the polishing head, the main body having a first end portion and a second end portion, and the main body to horizontally extend from the first end portion in a first circumferential direction to the second end portion such that the main body is less than a complete circumferential shape;

a guide disposed at a lower portion of the main body and having a pointed shape toward the surface plate, the guide having a first end portion and a second end portion, and the guide to horizontally extend from the first end portion of the guide in the first circumferential direction to the second end portion of the guide such that the guide is less than a complete circumferential shape;

at least one suction hole disposed in the guide so as to be adjacent to the at least one polishing head;

a flow path which communicates with the at least one suction hole and through which the sucked particles move is formed at an inner side of the main body and the guide; and an air pump installed at the index and configured to suck the particles through the guide and move the particles along the flow path, wherein the first end portion of the main body is horizontally spaced apart from the second end portion of the main body in the first circumferential direction, the main body and the guide have a shape of a horse's hoof in a horizontal direction, and the first end portion of the guide is horizontally spaced apart from the second end portion of the guide in the first circumferential direction, wherein a separation distance between the first end portion of the guide and the second end portion of the guide in a second circumferential direction is same as a separation distance between the first end portion of the main body and the second end portion of the main body in the second circumferential direction, wherein the second circumferential direction is opposite to the first circumferential direction, wherein the slurry injection nozzle is external to the main body and is disposed between the first end portion of the main body and the second end portion of the main body, wherein the flow path is provided in a vertical direction from the at least one suction hole disposed in the guide to the main body, and wherein the guide is disposed above the surface plate in the vertical direction, and the main body is disposed above the guide in the vertical direction.

2. The wafer polishing apparatus of claim 1, wherein the at least one suction hole has a slot shape disposed along an inner circumferential surface of the guide.

3. The wafer polishing apparatus of claim 1, wherein the at least one suction hole comprises a plurality of suction sub holes disposed at the guide, and each of the plurality of suction sub holes are spaced apart from each other.

4. The wafer polishing apparatus of claim 3, wherein the main body comprises a plurality of main body parts, and the guide comprises a plurality of guide parts, each of the plurality of main body parts are spaced apart from each other and each of the plurality of guide parts are spaced apart from each other, and the plurality of main body parts and the plurality of guide parts are disposed to surround the portion of the outer circumferential surface of the polishing head.

5. The wafer polishing apparatus of claim 4, further comprising an exhaust part disposed at a lower portion of the surface plate to suck and discharge the particles.

6. The wafer polishing apparatus of claim 1, wherein the vertical direction is perpendicular to the horizontal direction.

7. The wafer polishing apparatus of claim 1, wherein the guide has the pointed shape in the vertical direction toward the surface plate.

* * * * *